US006462484B2

(12) United States Patent
Dunphy et al.

(10) Patent No.: US 6,462,484 B2
(45) Date of Patent: Oct. 8, 2002

(54) PROCEDURES AND APPARATUS FOR TURNING-ON AND TURNING-OFF ELEMENTS WITHIN A FIELD EMISSION DISPLAY DEVICE

(75) Inventors: James C. Dunphy; Ronald L. Hansen; Brian E. Lindberg; Jerome M. Truppa, all of San Jose; Donald J. Elloway; Duke K. Amaniampong, both of Campbell, all of CA (US)

(73) Assignee: Candescent Intellectual Property Services, San Jose, CA (US)

( * ) Notice: Subject to any disclaimer, the term of this patent is extended or adjusted under 35 U.S.C. 154(b) by 0 days.

(21) Appl. No.: 09/796,868

(22) Filed: Feb. 28, 2001

(65) Prior Publication Data

US 2002/0101170 A1 Aug. 1, 2002

Related U.S. Application Data

(63) Continuation-in-part of application No. 09/493,698, filed on Jan. 28, 2000, which is a continuation of application No. 09/144,675, filed on Aug. 31, 1998, now Pat. No. 6,104,139.

(51) Int. Cl.[7] ..... G09G 3/10

(52) U.S. Cl. ..... 315/169.3; 315/169.1; 345/74; 345/76; 313/497; 313/495

(58) Field of Search ..... 315/169.3, 169.1; 345/74, 76, 70; 313/497, 495

(56) References Cited

U.S. PATENT DOCUMENTS 5,721,560 A * 2/1998 Cathy, Jr. et al. ..... 345/74
5,938,495 A * 8/1999 Ito ..... 445/24
6,104,139 A * 8/2000 Elloway et al. ..... 315/169.3
6,307,325 B1 * 10/2001 Elloway et al. ..... 315/169.3
6,307,326 B1 * 10/2001 Elloway et al. ..... 315/169.3

* cited by examiner

*Primary Examiner*—Don Wong
*Assistant Examiner*—Tuyet T. Vo
(74) *Attorney, Agent, or Firm*—Wagner, Murabito & Hao LLP

(57) ABSTRACT

A circuit and method for turning-on and turning-off elements of an field emission display (FED) device to protect against emitter electrode and gate electrode degradation. The circuit includes control logic having a sequencer which in one embodiment can be realized using a state machine. Upon power-on, the control logic sends an enable signal to a high voltage power supply that supplies voltage to the anode electrode. At this time a low voltage power supply and driving circuitry are disabled. Upon receiving a confirmation signal from the high voltage power supply, the control logic enables the low voltage power supply which supplies voltage to the driving circuitry. Upon receiving a confirmation signal from the low voltage power supply, or optionally after expiration of a predetermined time period, the control logic then enables the driving circuitry which drives the gate electrodes and the emitter electrodes which make up the rows and columns of the FED device. Upon power down, the control logic first disables the low voltage power supply, then the high voltage power supply. The above may occur upon each time the FED is powered-on and powered-off during the normal operational use of the display. By so doing, embodiments of the present invention reduce emitter electrode and gate electrode degradation by restricting electron emission from the emitter electrode directly to the gate electrode.

35 Claims, 10 Drawing Sheets

400

500

600

PROCEDURES AND APPARATUS FOR TURNING-ON AND TURNING-OFF ELEMENTS WITHIN A FIELD EMISSION DISPLAY DEVICE

RELATED US PATENT APPLICATION

The following patent application is a continuation-in-part of copending U.S. patent application Ser. No. 09/493,698, filed on Jan. 28, 2000 which is a continuation patent application of U.S. patent application Ser. No. 09/144,675, filed on Aug. 31, 1998 which is now U.S. Pat. No. 6,104,139.

FIELD OF THE INVENTION

The present invention pertains to the field of flat panel display screens. More specifically, the present invention relates to the field of flat panel field emission display screens.

BACKGROUND OF THE INVENTION

Flat panel field emission displays (FEDs), like standard cathode ray tube (CRT) displays, generate light by impinging high energy electrons on a picture element (pixel) of a phosphor screen. The excited phosphor then converts the electron energy into visible light. However, unlike conventional CRT displays which use a single or in some cases three electron beams to scan across the phosphor screen in a raster pattern, FEDs use stationary electron beams for each color element of each pixel. This requires the distance from the electron source to the screen to be very small compared to the distance required for the scanning electron beams of the conventional CRTs. In addition, FEDs consume far less power than CRTs. These factors make FEDs ideal for portable electronic products such as laptop computers, pagers, cell phones, pocket-TVs, personal digital assistants, and portable electronic games.

One problem associated with the FEDs is that the FED vacuum tubes may contain minute amounts of contaminants which can become attached to the surfaces of the electron-emissive elements, faceplates, gate electrodes, focus electrodes, (including dielectric layer and metal layer) and spacer walls. These contaminants may be knocked off when bombarded by electrons of sufficient energy. Thus, when an FED is switched on or switched off, there is a high probability that these contaminants may form small zones of high pressure within the FED vacuum tube.

In addition, electron emission from the emitter electrodes to the gate electrodes can cause both emitter and gate degradation. For instance, the gate is positive with respect to the emitter causing an attraction of electrons from the emitter electrodes to the gate electrodes. In addition, the presence of the high pressure facilitates electron emission from emitters to gate electrodes. The result is that some electrons may strike the gate electrodes rather than the display screen. This situation can lead to gate electrode degradation including overheating of the gate electrodes. The emission to the gate electrodes can also affect the voltage differential between the emitters and the gate electrodes. Electron emission from the emitter electrodes to the gate electrodes can also cause ions and other material debris to be released from the gate and thereby become attached to the emitter electrode. This can cause emitter degradation.

It is worth noting that electrons may also hit spacer walls and focus electrodes, causing non-uniform emitter degradation. Problems occur when electrons hit any surface except the anode, as these other surfaces are likely to be contaminated and out gas because they are not scrubbed by the electron beam during normal tube operation.

In addition, as the electrons jump the gap between the electron-emissive elements and the gate electrode, a luminous discharge of current may also be observed. Severe damage to the delicate electron-emitters may also result. Naturally, this phenomenon, generally known as "arcing," is highly undesirable.

Conventionally, one method of avoiding the arcing problem is by manually scrubbing the FED vacuum tubes to remove contaminant material. However, it is difficult to remove all contaminants with that method. Further, the process of manual scrubbing is time-consuming and labor intensive, unnecessarily increasing the fabrication cost of FED screens.

SUMMARY OF THE DISCLOSURE

Accordingly, an embodiment of the present invention provides an improved method of removing contaminant particles from the FED screen. The present invention also provides for an improved method and circuit of operating field emission displays to prevent gate-to-emitter currents during turn-on and turn-off thereby reducing potential gate and emitter electrode degradation. These and other advantages of the present invention not specifically described above will become clear within discussions of the present invention herein.

Embodiments of the present invention provide for a method of removing contaminant material in newly fabricated field emission displays. According to one embodiment of the present invention, contaminant particles are removed by a conditioning process, which includes the steps of: a) driving an anode of a field emission display (FED) to a predetermined voltage; b) slowly increasing an emission current of the FED after the anode has reached the predetermined voltage; and c) providing an ion-trapping device for catching the ions and contaminants knocked off by emitted electrons. In this embodiment, by driving the anode to the predetermined voltage and by slowly increasing the emission current of the FED, contaminant species are effectively removed without damaging the FED.

Embodiments of the present invention also provide for a method and circuit for operating FEDs to prevent gate-to-emitter current during turn-on and turn-off. This embodiment protects against emitter and gate degradation during FED operation. In this embodiment, the method includes the steps of: a) enabling the anode display screen; and, b) enabling the electron-emitters a predetermined time after the anode display screen is enabled. In this embodiment, by allowing sufficient time for the anode display screen to reach a predetermined voltage before the emitter is enabled, the emitted electrons will be attracted to the anode. In this way, gate-to-emitter current, gate to spacer current, and gate to focus current are effectively eliminated when an FED is turned on. In the present embodiment, the anode display screen is enabled by applying a predetermined high voltage to the display screen, and the electron-emitters are enabled by driving appropriate voltages to the gate electrodes and emitter electrodes of the FED.

In yet another embodiment of the present invention, the method of operating field emission displays to prevent gate-to-emitter current includes the steps of: a) disabling the emitters for a predetermined time; and, b) disabling the anode display screen after the electron-emitters are disabled. In this embodiment, by allowing sufficient time for the electron-emitters to be disabled before disabling the anode display screen, all remaining electrons will be attracted to the anode. In this way, gate-to-emitter current is eliminated during a turn-off sequence of the FED. In the present embodiment, the anode display screen may be disabled by removing the voltage source from the anode and allowing it to be at ground potential, and the electron-emitters are disabled by driving the gate electrodes and the emitter electrodes to the ground voltage.

In yet another embodiment, the present invention includes a circuit and method for turning-on and turning-off elements of a field emission display (FED) device to protect against emitter electrode and gate electrode degradation. The circuit includes control logic having a sequencer which in one embodiment can be realized using a state machine. Upon power-on, the control logic sends an enable signal to a high voltage power supply that supplies voltage to the anode electrode. At this time a low voltage power supply and driving circuitry are disabled. Upon receiving a confirmation signal from the high voltage power supply, the control logic enables the low voltage power supply which supplies voltage to the driving circuitry. Upon receiving a confirmation signal from the low voltage power supply, or optionally after expiration of a predetermined time period, the control logic then enables the driving circuitry which drives the gate electrodes and the emitter electrodes which make up the rows and columns of the FED device. Upon power down, the control logic first disables the low voltage power supply, then the high voltage power supply. The above may occur each time the FED is powered-on and powered-off during the normal operational use of the display. By so doing, embodiments of the present invention reduce emitter electrode and gate electrode degradation by restricting electron emission from the emitter electrode directly to the gate electrode, the focus electrode or the spacers.

Embodiments of the present invention include the above and further include a method of operating a field emission display, the method comprising the steps of: providing the field emission display with electron-emissive elements for emitting electrons, a gate electrode for controlling electron emission from the electron-emissive elements, and a display screen for collecting the electrons; enabling the display screen to establish a voltage differential between the display screen and the electron-emissive elements; and following enabling of the display screen, enabling the gate electrode by delaying substantial electron emission from the electron-emissive elements until the voltage differential has been established to direct the electrons towards the display screen and to substantially prevent the electrons from striking the gate electrode.

Embodiments of the present invention further include a field emission display device comprising: a baseplate; a plurality of electron-emissive elements on the baseplate; a gate electrode on the baseplate for controlling electron emission from the electron-emissive elements; a display screen spaced from the baseplate and configured for collecting electrons emitted from the electron-emissive elements to generate an image thereon; and a control circuit configured to control a flow of electrons to the electron-emissive elements, the control circuit allowing a voltage differential to be established between the display screen and the electron-emissive elements prior to substantial electron emission from the electron-emissive elements to prevent substantial gate-to-emitter current during turn on of the field emission display device.

Embodiments also include a field emission display device comprising: a display screen comprising: rows and columns of; and an anode electrode, wherein each of the pixels comprises respective emitter electrodes and respective gate electrodes that are controlled by driver circuitry; a high voltage power supply coupled to provide a high voltage to the anode electrode and coupled to receive a first enable signal, the high voltage power supply also for generating a confirmation signal upon reaching its operational voltage; a low voltage power supply coupled to provide a low voltage to the driver circuitry and coupled to receive a second enable signal; and control logic coupled to the high and low voltage power supplies and also coupled to the driver circuitry, the control logic, in response to a power-on signal, for powering-on the display screen by generating the first enable signal and then generating the second enable signal in response to the confirmation signal to prevent electron emission from the emitter to the gate electrodes.

Embodiments include the above and wherein the driver circuitry is coupled to receive a third enable signal and wherein the control logic is also for enabling the driver circuitry by generating the third enable signal after enabling the low voltage power supply. Embodiments include the above and wherein the control logic is also for powering-down the display screen by first disabling the low voltage power supply and then by disabling the high voltage power supply. Embodiments include the above and wherein the control logic is realized by a state machine sequencer and further comprising a gas-trapping device to trap contaminants within the display screen.

BRIEF DESCRIPTION OF THE DRAWINGS

The accompanying drawings, which are incorporated in and form a part of this specification, illustrate embodiments of the present invention and, together with the description, serve to explain the principles of the invention.

DETAILED DESCRIPTION OF THE PREFERRED EMBODIMENTS

Reference will now be made in detail to the present embodiments of the invention, examples of which are illustrated in the accompanying drawings, and including a method and circuit for powering-on and powering-off an FED screen during normal operation to reduce emitter and gate electrode degradation. While the invention will be described in conjunction with the present embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following description, for purposes of explanation, numerous specific details are set forth in order to provide a thorough understanding of the present invention. It will be apparent, however, to one skilled in the art, upon reading this disclosure, that the present invention may be practiced without these specific details. In other instances, well-known structures and devices are not described in detail in order to avoid obscuring aspects of the present invention.

GENERAL DESCRIPTION OF FIELD EMISSION DISPLAYS

Figure 1:
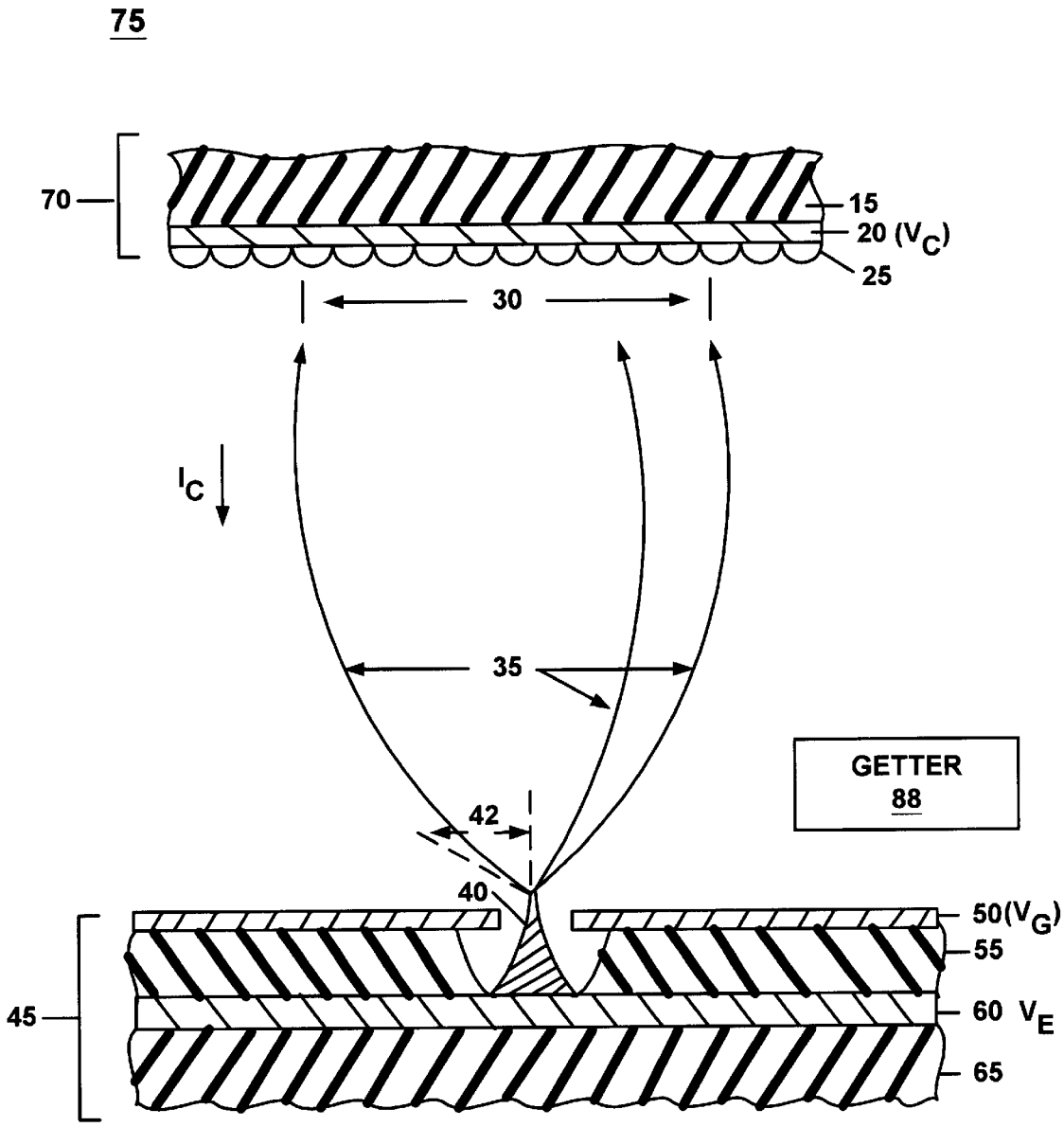
FIG. 1 is a cross section structural view of part of an exemplary flat panel FED screen that utilizes a gated field emitter situated at the intersection of a row line and a column line.

A general description of field emission displays is presented. FIG. 1 illustrates a multi-layer structure 75 which is a cross-sectional view of a portion of an FED flat panel display. The multi-layer structure 75 contains a field-emission backplate structure 45, also called a baseplate structure, and an electron-receiving faceplate structure 70. An image is generated at faceplate structure 70. Backplate structure 45 commonly consists of an electrically insulating backplate 65, an emitter (or cathode) electrode 60, an electrically insulating layer 55, a patterned gate electrode 50, and a conical electron-emissive element 40 situated in an aperture through insulating layer 55. One type of electron-emissive element 40 is described in U.S. Pat. No. 5,608,283, issued on Mar. 4, 1997 to Twichell et al. and another type is described in U.S. Pat. No. 5,607,335, issued on Mar. 4, 1997 to Spindt et al., which are both incorporated herein by reference. The tip of the electron-emissive element 40 is exposed through a corresponding opening in gate electrode 50. Emitter electrode 60 and electron-emissive element 40 together constitute a cathode of the illustrated portion 75 of the FED flat panel display. Faceplate structure 70 is formed with an electrically insulating faceplate 15, an anode 20, and a coating of phosphors 25. Electrons emitted from element 40 are received by phosphors portion 30. In one embodiment, electron emissive element 40 includes a conical molybdenum tip. In other embodiments of the present invention, the anode 20 may be positioned over the phosphors 25, and the emitter 40 may include other geometrical shapes such as a filament.

The emission of electrons from the electron-emissive element 40 is controlled by applying a suitable voltage ($V_G$) to the gate electrode 50. Another voltage ($V_E$) is applied directly to the electron-emissive element 40 by way of the emitter electrode 60. Electron emission increases as the gate-to-emitter voltage, e.g., $V_G$ minus $V_E$, or $V_{GE}$, is increased. Directing the electrons to the phosphor 25 is performed by applying a high voltage ($V_C$) to the anode 20. When a suitable gate-to-emitter voltage $V_{GE}$ is applied, electrons are emitted from electron-emissive element 40 at various values of off-normal emission angle theta 42. The emitted electrons follow non-linear (e.g., parabolic) trajectories indicated by lines 35 in FIG. 1 and impact on a target portion 30 of the phosphors 25. Thus, $V_G$ and $V_E$ determine the magnitude of the emission current ($I_C$), while the anode voltage $V_C$ controls the direction of the electron trajectories for a given electron emitted at a given angle. Dislodged by electron bombardment, contaminants contained in the vacuum tube of an FED are collected by a gas-trapping device (e.g., a getter) 88.

Figure 2:
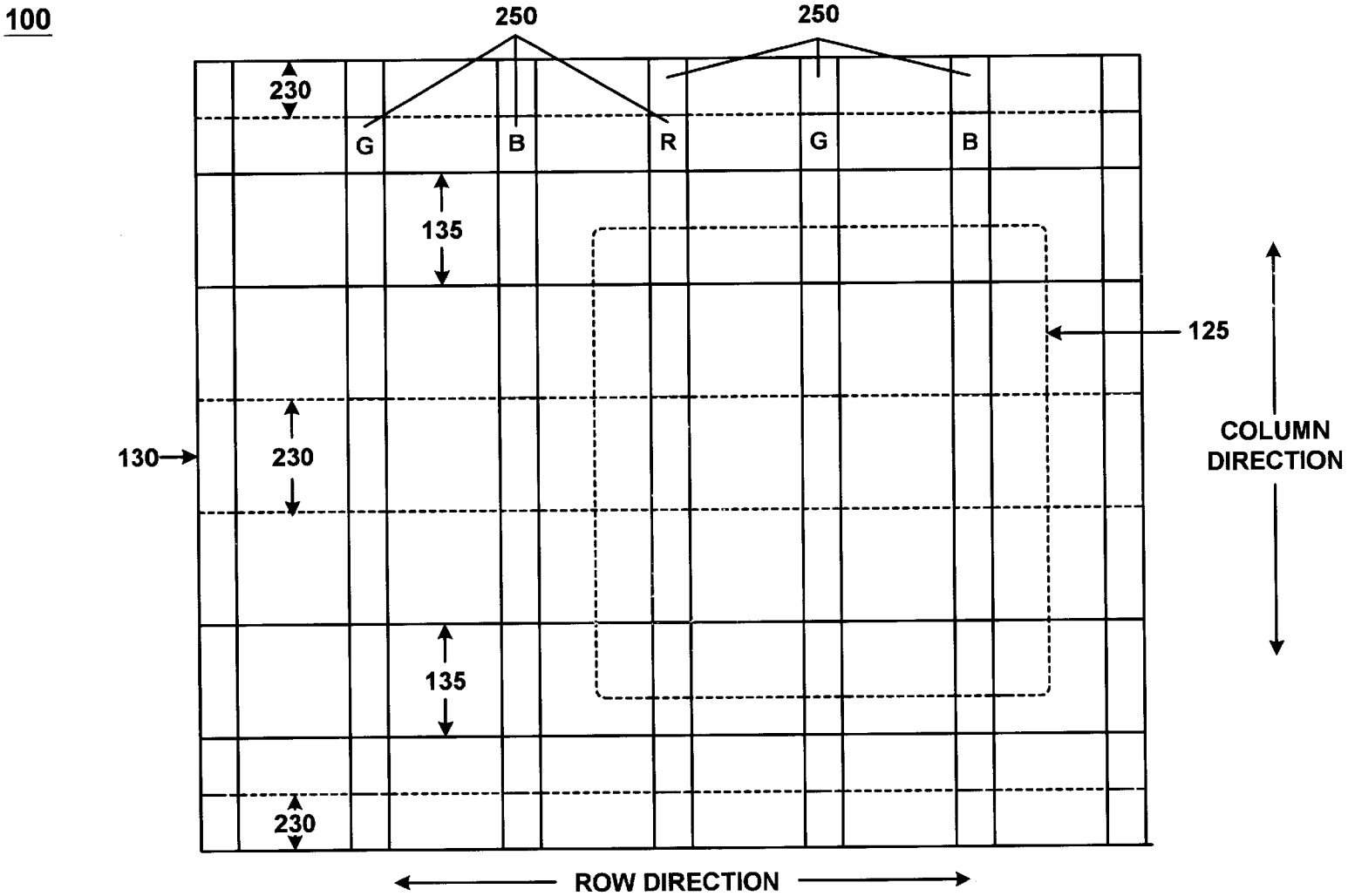
FIG. 2 illustrates an exemplary FED screen in accordance with one embodiment of the present invention.

FIG. 2 illustrates a portion of an exemplary FED screen 100. The FED screen 100 is subdivided into an array of horizontally aligned rows and vertically aligned columns of pixels. The boundaries of a respective pixel 125 are indicated by dashed lines. Three separate row lines 230 are shown. Each row line 230 is a row electrode for one of the rows of pixels in the array. In one embodiment, each row line 230 is coupled to the emitter cathodes of each emitter of the particular row associated with the electrode. A portion of one pixel row is indicated in FIG. 2 and is situated between a pair of adjacent spacer walls 135. In other embodiments, spacer walls 135 need not be between each row. And, in some displays, space walls 135 may not be present. A pixel row includes all of the pixels along one row line 230. Two or more pixels rows (and much as 24–100 pixel rows), are generally located between each pair of adjacent spacer walls 135.

In color displays, each column of pixels has three column lines 250: (1) one for red; (2) a second for green; and (3) a third for blue. Likewise, each pixel column includes one of each phosphor stripes (red, green, blue), three stripes total. In a monochrome display, each column contains only one stripe. In the present embodiment, each of the column lines 250 is coupled to the gate electrode of each emitter structure of the associated column. Further, in the present embodiment, the column lines 250 for coupling to column driver circuits (not shown) and the row lines 230 are for coupling to row driver circuits (not shown).

In operation, the red, green and blue phosphor stripes are maintained at a high positive voltage relative to the voltage of the emitter-cathode 60/40. When one of the sets of electron-emission elements is suitably excited by adjusting the voltage of the corresponding row lines 230 and column lines 250, elements 40 in that set emit electrons which are accelerated toward a target portion 30 of the phosphors in the corresponding color. The excited phosphors then emit light. During a screen frame refresh cycle (performed at a rate of approximately 60 Hz in one embodiment), only one row is active at a time and the column lines are energized to illuminate the one row of pixels for the on-time period. This is performed sequentially in time, row by row, until all pixel rows have been illuminated to display the frame. The above FED configuration is described in more detail in the following United States Patents: U.S. Pat. No. 5,541,473 issued on Jul. 30, 1996 to Duboc, Jr. et al.; U.S. Pat. No. 5,559,389 issued on Sep. 24, 1996 to Spindt et al.; U.S. Pat. No. 5,564,959 issued on Oct. 15, 1996 to Spindt et al.; and U.S. Pat. No. 5,578,899 issued Nov. 26, 1996 to Haven et al., which are incorporated herein by reference.

FED CONDITIONING PROCEDURE ACCORDING TO ONE EMBODIMENT OF THE PRESENT INVENTION

The present invention provides for a process of conditioning newly fabricated FEDs to remove contaminant species contained therein. The conditioning process is performed before the FED device is used in normal operations, and is typically performed during manufacturing. During the conditioning process of the present invention, contaminants contained in the vacuum tube of an FED are bombarded by a large amount of electrons. As a result of the bombardment, the contaminants will be knocked off and collected by a gas-trapping device (e.g., a getter). Because newly fabricated FEDs contain a large amount of contaminants, precautious steps must be taken to ensure that arcing does not occur during the conditioning process in accordance with the present invention. To this end, according to the present invention, the conditioning process includes the step of driving the anode to a predetermined high voltage and the step of enabling the emission cathode thereafter to ensure that the electrons are pulled to the anode. In furtherance of one embodiment of the present invention the emission current is slowly increased to the maximum value after the anode voltage has reached the predetermined high voltage.

Figure 3:
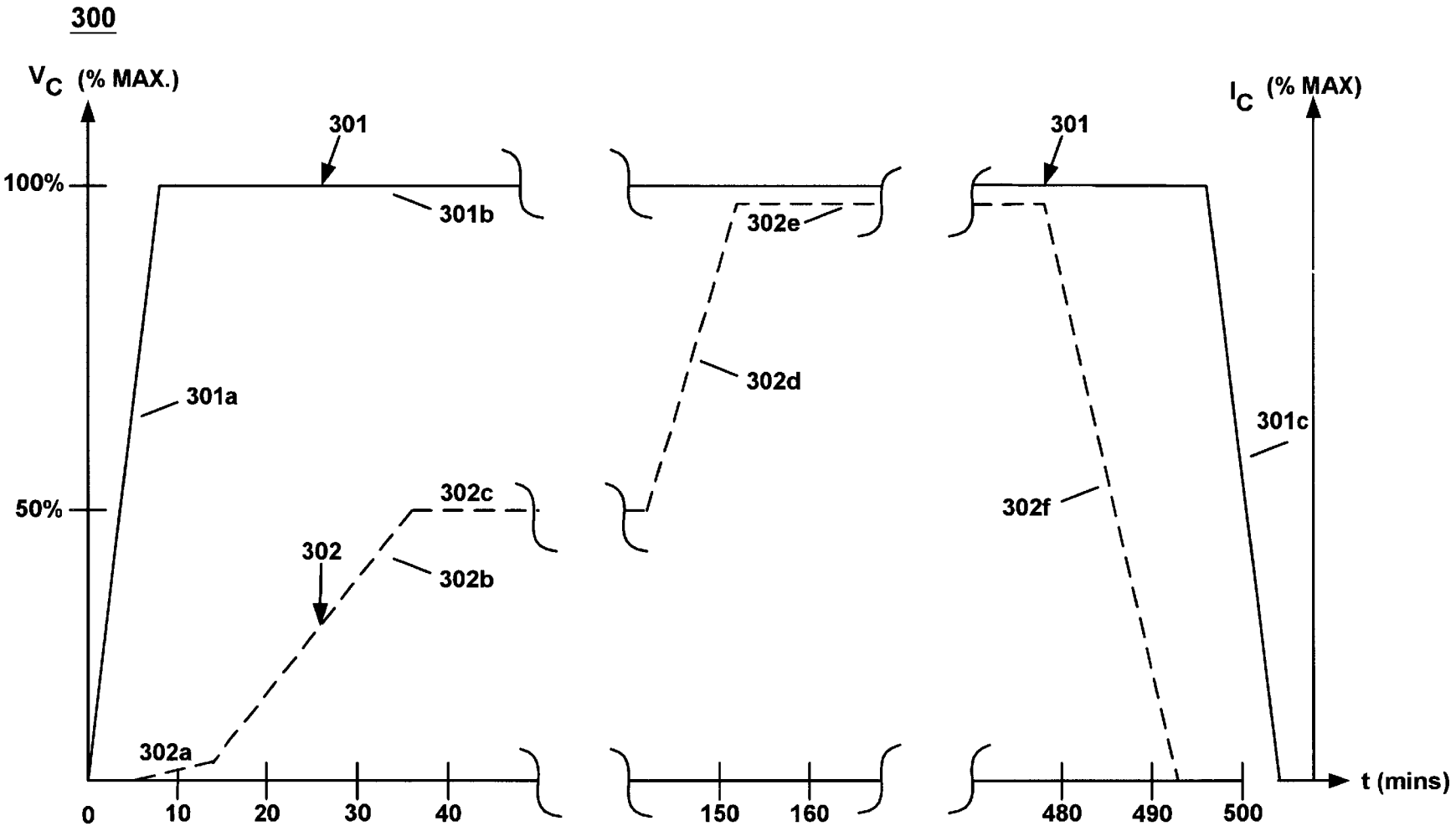
FIG. 3 illustrates a voltage and current application technique for turning-on an FED device according to one embodiment of the present invention.

FIG. 3 illustrates a plot 300 showing the changes in anode voltage level and emission current level of a particular FED during the conditioning process of the present embodiment. Plot 301 illustrates the changes in anode voltage ($V_C$), and plot 302 illustrates the changes in emission current ($I_C$). Particularly, $V_C$ is represented as a percentage of a maximum anode voltage provided by the driver electronics. For instance, for a high voltage phosphor, a maximum anode voltage may be 3,000 volts. It should be noted that the maximum anode voltage may not be the normal operational voltage of the anode. For example, the normal operational voltage of the display screen may be 25% to 75% of the maximum anode voltage. $I_C$ is represented as a percentage of a maximum emission current provided by the driver circuits of the FED. Driver electronics and electronic equipment for providing high voltages and large currents to FEDs are well known in the art, and are therefore not discussed herein to avoid obscuring aspects of the present invention.

According to the present invention, plot 301 includes a voltage ramp segment 301*a*, a first level segment 301*b*, and a voltage drop segment 301*c*; and plot 302 includes a first current ramp segment 302*a*, a second current ramp segment 302*b*, a second level segment 302*c*, a third current ramp segment 302*d*, a third level segment 302*e*, and a current drop segment 302*f*. In the particular embodiment as shown, in the voltage ramp segment 301*a*, VC increases from 0% to 100% of the maximum anode voltage over a period of approximately 5 minutes. Significantly, $I_C$ remains at 0% as $V_C$ increases to ensure that the electrons are pulled towards the display screen (anode) instead of the gate electrodes.

After $V_C$ has reached 100% of the maximum anode voltage, $V_C$ is maintained at that voltage level for roughly 25 minutes. Contemporaneously, $I_C$ is slowly increased from 0% to 1% of the maximum emission current over approximately 10 minutes (first current ramp segment 302*a*). Thereafter, $I_C$ is slowly increased to 50% of the maximum emission current over approximately 20 minutes (second current ramp segment 302b). $I_C$ is then maintained at the 50% level for roughly 10 minutes (third level segment 302*c*). According to the present invention, $I_C$ is increased at a slow rate to avoid the formation of high ionic pressure zones formed by desorption of the electron emitters. Desorbed molecules may form small zones of high ionic pressure, which may increase the risk of arcing. Thus, by slowly increasing the emission current, the occurrence of arcing is significantly reduced.

According to FIG. 3, $I_C$ is then maintained at a constant level for approximately 10 minutes (third level segment 302*c*) for "soaking" occur. Soaking refers to the process by which contaminant species are removed by gas-trapping devices. Gas-trapping devices, generally known as "getters," are used by the present invention at this stage of the conditioning process and are well known in the art.

In one embodiment, after the soaking period, $I_C$ is then subsequently increased to 100% of its maximum level (third current ramp 302*d*) and, thereafter, remained at that level for approximately 2 hours (fourth level segment 302*e*). Contemporaneously, $V_C$ is maintained at its maximum level. Thereafter, $V_C$ and $I_C$ are then subsequently brought back to 0% of their respective maximum values. Significantly, as illustrated by segments 302*f* and 301*c* of FIG. 3, $I_C$ is turned off before $V_C$ is turned off. In this way, it is ensured that all emitted electrons are pulled towards the display screen (anode) and that gate-to-emitter currents are prevented.

During the conditioning process of the present invention, any knocked off or otherwise released contaminants are collected by gas-trapping devices, otherwise known as "getters." Getters, as discussed above, are well known in the art. In the particular embodiment as illustrated in FIG. 3, the total conditioning period is roughly six hours. After this conditioning period, most of the contaminants would have been knocked off and collected by the getters, and the newly fabricated FED screen would be ready for normal operation.

Some gas species, CH(4) for example, are not pumped by the getter. These species are pumped by the tube operation. Electrons break apart and ionized the gas molecules. The ions are accelerated by the electric field into the cathode and faceplate.

Figure 4:
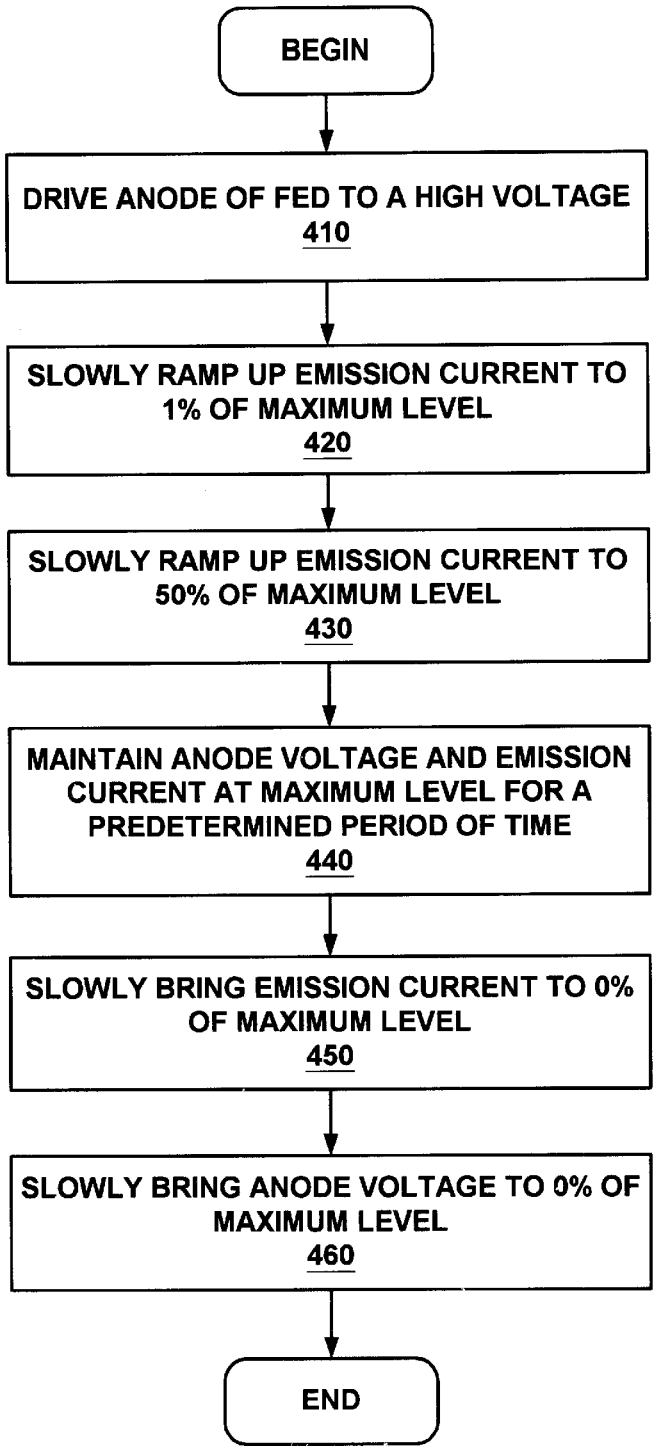
FIG. 4 illustrates a flow diagram of the steps of an FED conditioning process according to one embodiment of the present invention.

FIG. 4 is a flow diagram 400 illustrating steps of the FED conditioning process according to the present invention. To facilitate the discussion of the present invention, flow diagram 400 is described in conjunction with exemplary FED structure 75 illustrated in FIG. 1. With reference now to FIGS. 1 and 4, at step 410, the anode 20 of the FED is driven to a high voltage. It should be noted that, at step 410, the emission current ($I_C$) is maintained at 0% of the maximum level, and is therefore off. In one embodiment of the present invention, the voltage of the gate electrode 50 and the emitter-cathode 60/40 are maintained at ground. The anode voltage is driven to a high voltage while maintaining an emission current at 0% to ensure that the electrons, once emitted, are pulled to the anode 20 rather than the gate electrode 50.

At step 420 of FIG. 4, the emission current $I_C$ is slowly increased to 1% of a maximum emission current provided by driver electronics of the FED. In one particular embodiment of the present invention, step 420 takes roughly 5 minutes to accomplish. The slow ramp up ensures that localized zones of high ionic pressure will not be formed by desorption of the electron emitters. Further, in the present embodiment, the emission current $I_C$ is proportional to the gate-to-emitter voltage ($V_{GE}$) as predicted by the Fowler-Nordheim theory. Thus, in the present embodiment, the emission current $I_C$ may be controlled by adjusting the gate-to-emitter voltage $V_{GE}$.

At step 430 of FIG. 4, the emission current $I_C$ is ramped up to approximately 50% of the maximum emission current provided by driver electronics of the FED. In one embodiment, step 430 takes roughly 10 minutes to accomplish. As in step 420, the slow ramp up allows ample time for desorbed molecules to diffuse away, and ensures that localized zones of high ionic pressure are not formed.

At step 440 of FIG. 4, emission current $I_C$ and anode voltage $V_C$ are maintained at 100% of their respective maximum values such that a large amount of electrons will be emitted. The emitted electrons will bombard and knock off most loose contaminants unremoved by previous fabricating processes. The knocked off contaminants are subsequently trapped by ion-trapping devices such as the getters. As discussed above, getters are well known in the art, and are therefore not described herein to avoid obscuring aspects of the invention.

At step 450, the emission current is brought to 0% of the maximum value.

Subsequently, at step 460, the anode voltage is brought to 0% of its maximum value. It is important to note that emission current is turned-off prior to turning-off the anode voltage such that all emitted electrons will be attracted to the anode. Thereafter, the conditioning process 400 ends.

Figure 5:
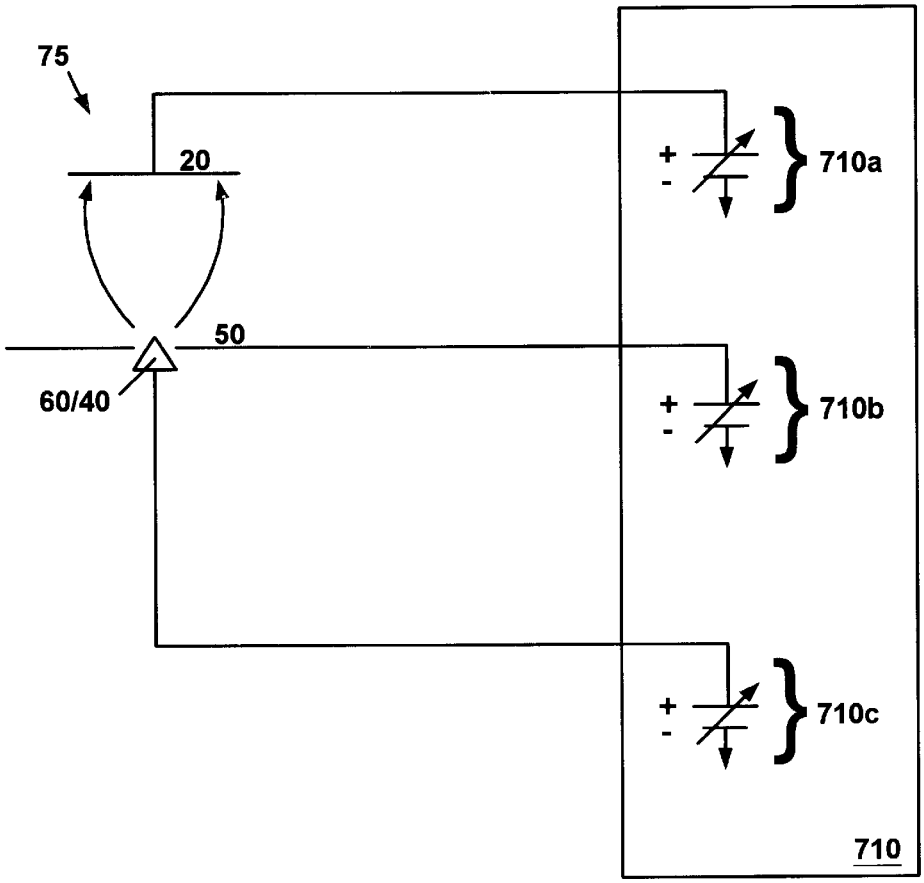
FIG. 5 illustrates a block diagram of a system for conditioning an FED according to one embodiment of the present invention.

FIG. 5 is a block diagram 700 illustrating an apparatus for controlling the conditioning process according to one embodiment of the present invention.

A simplified diagram of the FED 75 of FIG. 1 is also illustrated. With reference to FIG. 5, the apparatus includes a controller circuit 710 configured for coupling to FED 75. Particularly, controller circuit 710 includes a first voltage control circuit 710*a* for providing an anode voltage to anode 20 of FED 75. Controller circuit 710 further includes a second voltage control circuit 710*b* for providing a gate voltage to gate electrode 50, and third voltage control circuit 710*c* for providing a emitter voltage to emitter cathode 60/40. It should be appreciated that the controller circuit 710 is exemplary, and that many different implementations of the controller circuit 710 may also be used.

In operation, the voltage control circuits 710*a–c* provide various voltages to the anode 20, gate electrode 50 and emitter electrode 60/40 of the FED 75 to provide for different voltages and emission current during the conditioning process of the present invention. In one embodiment of the present invention, the controller circuit 710 is a stand alone electronic equipment specially made for the present conditioning process to provide very high voltages. However, it should be appreciated that controller circuit 710 may also be implemented within an FED to control the anode voltage and emission currents during turn-on and turn-off of the FED.

FED TURN-ON AND TURN-OFF PROCEDURES OF THE PRESENT INVENTION

The present invention also provides for a method of operating a field emission display to minimize the risk of arcing during power-on and power-off of the FED unit. Particularly, according to one embodiment of the present invention, the method of operating an FED includes the steps of: turning on the anodic display screen of the FED, and, thereafter, turning on the emission cathodes. According to another embodiment of the present invention, the method of operating an FED to minimize the risk of arcing includes the steps of: turning off the emission cathodes, and thereafter, turning-off the anodic display screen. According to the present invention, the occurrence of arcing is substantially reduced by following the aforementioned steps.

Figure 6:
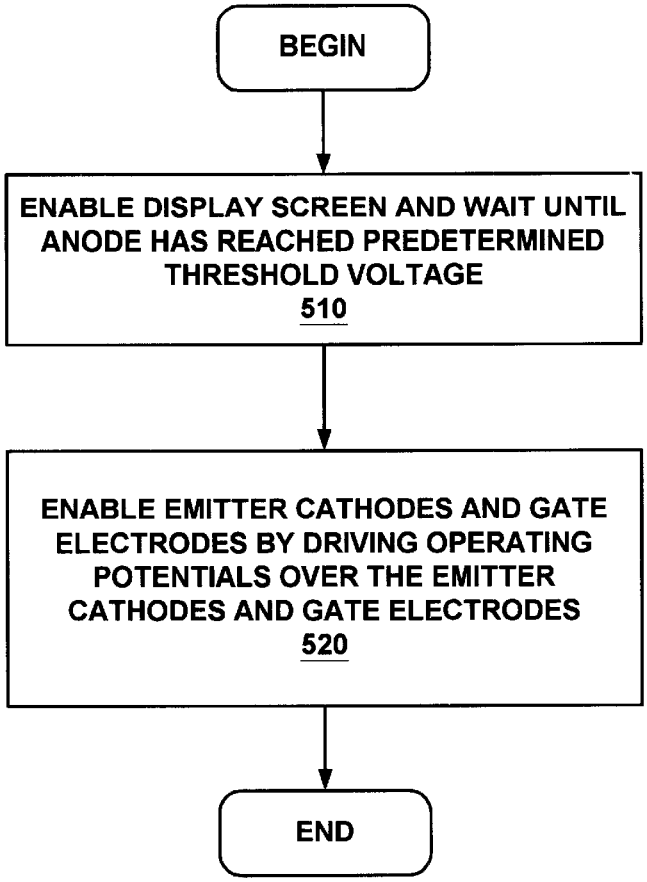
FIG. 6 illustrates a flow diagram of the steps of an FED turn-on procedure according to another embodiment of the present invention.

FIG. 6 illustrates a flow diagram 500 of steps within an FED turn-on procedure according to another embodiment of the present invention. In order to facilitate the discussion of the present invention, flow diagram 500 is described in conjunction with exemplary FED 75 of FIG. 1. With reference now to FIGS. 1 and 6, at step 510, when the FED 75 is switched on, the anode 20 is enabled. In the present embodiment, the anode is enabled by the application of a predetermined threshold voltage (e.g. 300 V). Further, in the present invention, the anode may be enabled by switching on a power supply circuit (not shown) that supplies power to the anode 20. Power supplies for FEDs are well known in the art, and any number of well know power supply devices can be used with the present invention.

At step 520, after the anode 20 of the FED 75 is enabled, and after the anode has reached the predetermined threshold voltage, the emitter cathode 60/40 and the gate electrode 50 of the FED 75 are then enabled. In the present invention, the emitter cathode 60/40 of the FED 75 is enabled a predetermined period after the anode 20 has been enabled to direct the electrons towards the anode 20 and to prevent the electrons from striking the gate electrode 50. In one embodiment, the emitter cathode 60/40 and the gate electrode 50 may be enabled by switching on the row and column driver circuits (not shown) of the FED.

Figure 7:
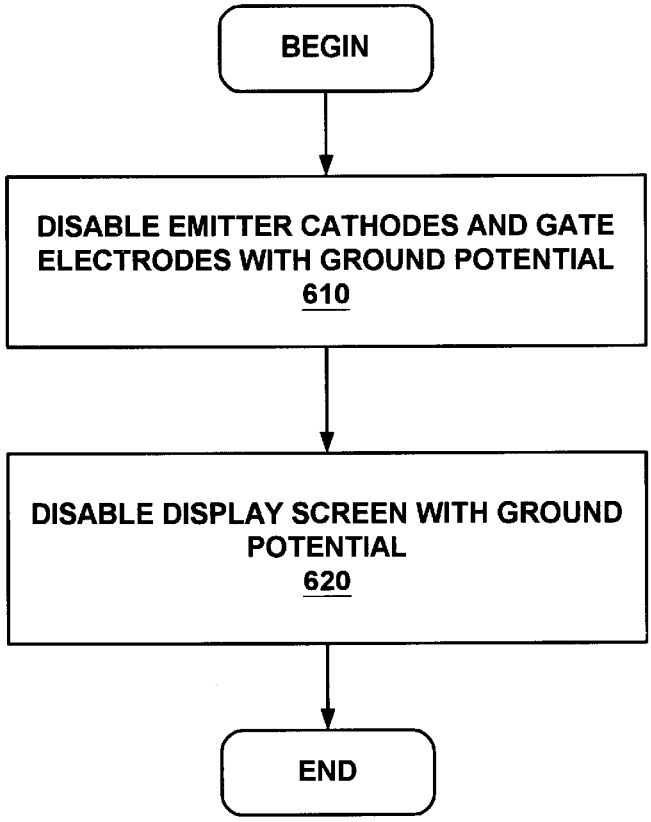
FIG. 7 illustrates a flow diagram of the steps of an FED turn-off procedure according to another embodiment of the present invention.

FIG. 7 is a flow diagram 600 illustrating steps of an FED turn-off procedure according to another embodiment of the present invention. In the following, flow diagram 600 is discussed in conjunction with exemplary FED 75 of FIG. 1. With reference now to FIG. 1 and 7, at step 610, when the FED is switched off, the emitter cathode 60/40 and the gate electrode 50 of the FED 75 are disabled. Contemporaneously, the anode 20 remains at a high voltage. Further, in one embodiment, the emitter cathode 60/40 and gate electrode 50 are disabled by setting the row voltages and column voltages respectively provided by row drivers and column drivers (not shown) to a ground potential.

At step 620, after the emitter cathode 60/40 and the gate electrode 50 are disabled, the anode 20 of the FED is disabled. According to the present invention, step 620 is performed after step 610 in order to ensure that all electrons emitted from emission cathodes will be attracted to the anodic display screen. In one embodiment, the anode 20 is disabled by switching off the power supply circuit (not shown) that supplies power to the anode 20. In this way, the occurrence of arcing in FEDs is minimized.

FED CONDITIONING PROCESS ACCORDING TO ANOTHER EMBODIMENT OF THE INVENTION

Figure 8:
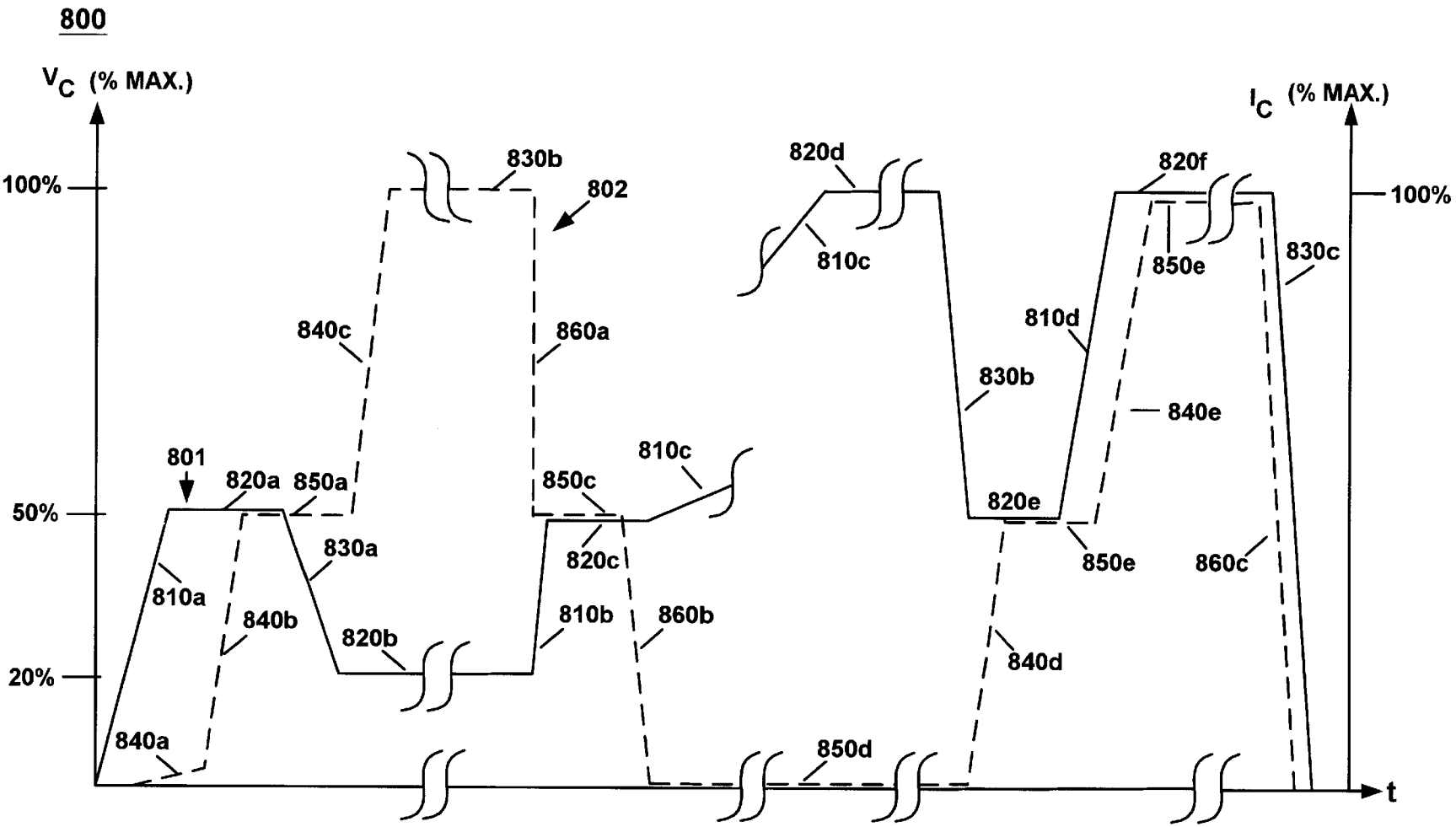
FIG. 8 illustrates a voltage and current application technique for turning-on an FED device according to another embodiment of the present invention.

FIG. 8 is a plot 800 illustrating a voltage and current application technique for conditioning a particular FED device according to another embodiment of the present invention. Plot 801 illustrates the changes in anode voltage ($V_C$), and plot 802 illustrates the changes in emission current ($I_C$).

Particularly, $V_C$ is represented as a percentage of a maximum anode voltage provided by the driver electronics. $I_C$ is represented as a percentage of a maximum emission current provided by the driver circuits of the FED.

According to the present invention, plot 801 includes voltage ramp segments 810*a–d*, constant voltage segments 820*a–f*, voltage drop segments 830*a–c*; and plot 302 includes current ramp segments 840*a–e*, constant current segments 850*a–e*, and current drop segments 860*a–c*. In the particular embodiment as shown, in the voltage ramp segment 810*a*, $V_C$ increases from 0% to 50% of the maximum anode voltage over a period of approximately 10 minutes. Significantly, $I_C$ remains at 0% as $V_C$ increases to ensure that the electrons are pulled towards the display screen (anode) instead of the gate electrodes.

After $V_C$ has reached 50% of the maximum anode voltage, $V_C$ is maintained at that voltage level for roughly 30 minutes (constant voltage segment 820*a*). Contemporaneously, $I_C$ is slowly increased from 0% to 1% of the maximum emission current over approximately 10 minutes (current ramp segment 840*a*). Thereafter, $I_C$ is slowly increased to 50% of the maximum emission current over approximately 10 minutes (current ramp segment 840*b*). $I_C$ is then maintained at the 50% level for roughly 10 minutes (constant current segment 850*a*). According to the present invention, $I_C$ is increased at a slow rate to avoid the formation of high pressure zones formed by desorption of the electron emitters. Desorbed molecules may form small zones of high pressure, which may increase the risk of arcing. By slowly increasing the emission current, ample time is allowed for the desorbed molecules may diffuse to gas-trapping devices (e.g., getters). In this way, occurrence of arcing is significantly reduced.

According to FIG. 8, $V_C$ is reduced from 50% to 20% level (voltage drop segment 830*a*) and is maintained at the 20% level for roughly 30 minutes (constant voltage segment 820*b*). After $V_C$ has reached the 20% level, $I_C$ is slowly ramped up to the 100% level (current ramp segment 840*c*). It should be noted that the 20% level is selected such that the anode voltage is close to a minimum threshold level for the anode of the FED to attract the emitted electrons. $I_C$ is then maintained at a constant level for approximately 20 minutes (constant current segment 820*b*) for "soaking" occur.

In the present embodiment, $I_C$ is then subsequently decreased to 50% of its maximum level (current drop segment 860*a*) and, thereafter, remained at that level for approximately 20 minutes (constant current segment 850*c*). After $I_C$ has reached the 50% level, $V_C$ is increased to the 50% level (voltage ramp segment 810*b*) and is maintained at that level for 20 minutes (constant current level 820*c*). Thereafter, $I_C$ is turned-off to 0% of its maximum value (current drop segment 860*b*).

After $I_C$ is turned off, $V_C$ is slowly ramped up to 100% of its maximum level over a period of approximately 2.5 hours (voltage ramp segment 810*c*), and is maintained at the maximum level for approximately 1 hour (constant voltage segment 820*d*). Thereafter, $V_C$ is decreased to the 50% level (voltage drop segment 830*b*), and is maintained at that level for approximately 20 minutes (constant voltage segment 820*e*). $I_C$ is slowly increased from 0% to the 50% level (current ramp 840d) when $V_C$ is at 50% level. $V_C$ and $I_C$ are then subsequently driven to 100% of their respective maximum values (voltage ramp segment 810*d* and current ramp segment 840*e*), and are maintained at those levels for approximately 1.5 hours (constant voltage segment 820*f* and constant current segment 850*e*). Thereafter, $V_C$ and $I_C$ are brought back to 0% (voltage drop segment 830*c* and current drop segment 860*c*).

Significantly, as illustrated by segments 810*d* and 840*e* of FIG. 8, $I_C$ is driven to the maximum value after $V_C$ is driven to the maximum value, and $I_C$ is turned off before $V_C$ is turned off. In this way, it is ensured that all emitted electrons are pulled towards the display screen (anode) and that gate-to-emitter currents are prevented.

OPERATIONAL USE POWER-ON AND POWER-OFF CIRCUIT OF AN EMBODIMENT OF THE PRESENT INVENTION

Figure 9:
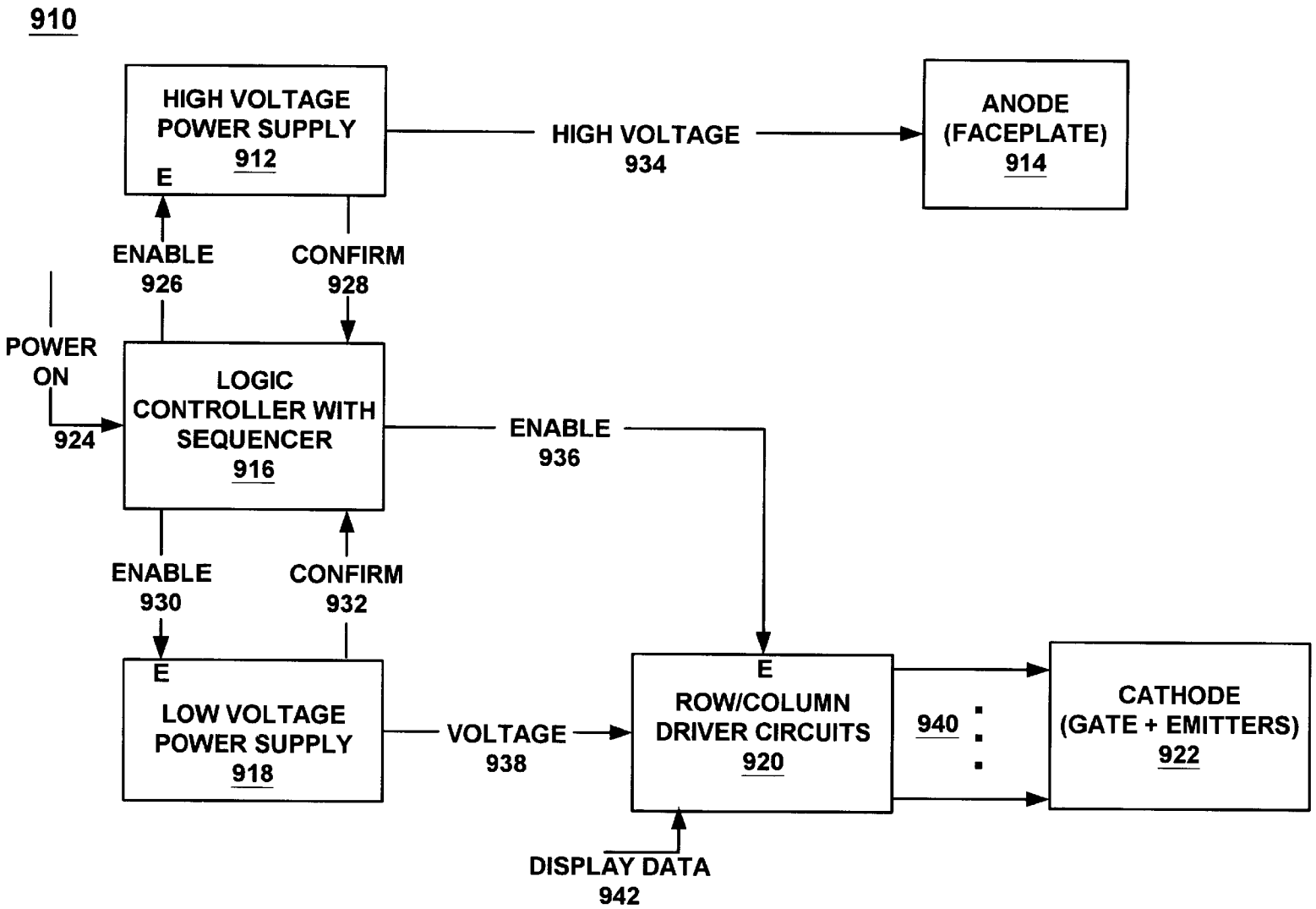
FIG. 9 illustrates a logical block diagram of a circuit in accordance with an embodiment of the present invention for use at power-on and power-off of the FED screen during normal operational use of the screen.

FIG. 9 illustrates a logical block diagram of a power-on/power-off circuit 910 in accordance with an embodiment of the present invention. Circuit 910 is used to power-on and to power-off the FED screen during the normal operational use of the screen. That is, circuit 910 is used on each time the FED screen is turned on and turned off. Circuit 910 is enforces a power on and power off procedure that is directed to reducing degradation of the emitter electrode 60 (FIG. 1) and gate electrode 50 (FIG. 1) during power-on and power-off of the FED screen.

In particular, circuit 910 in accordance with this embodiment of the present invention is used to insure that the anode electrode 20 (FIG. 1) is at a high voltage level before the emitter electrode 60 is energized. In this condition, electrons emitted from the emitter electrode 60 will be pulled toward the anode electrode 20 thereby avoiding any contact/collision with the gate electrode 50. Electron emission from the emitter to the gate electrode is responsible for materially degrading the gate electrode. Ions dislodged from the gate electrode as a result of this electron emission can also fall into the emitter electrode thereby degrading the emitter electrode as well.

FIG. 9 illustrates the components of circuit 910. A logic controller 916 is provided that contains a sequencer. The sequencer can be realized by an internal state machine. In response to a power-on signal from line 924, the logic controller 916 generates a first enable signal over line 926 which is coupled to a high voltage power supply 912. The power-on signal over line 924 can be responsive to an on/off switch. In response to a confirmation signal 928, the logic controller 916 also generates a second enable signal over line 930 which is coupled to a low voltage power supply 918. When not enabled by lines 926 and 930, the high and low voltage power supplies are disabled, e.g., they do not output any voltage level. The high voltage power supply is coupled, via power supply line 934, to the anode 20 (FIG. 1) of the faceplate, which in FIG. 9 is designated as 914. The low voltage power supply 918 is coupled, via power supply lines 938, to row and column driver circuits 920 as a their supply voltage. These row and column driver circuits are coupled to the gate electrodes and the emitter electrodes 922 that make up the display matrix (e.g., the rows and columns of pixels) within the FED device. Analog driving voltages are applied over lines 940 which are coupled to the gate and emitter electrodes, which in combination are called the "cathode."

The high voltage power supply 912 has an output 934 that can be enabled and disabled by line 926. The high voltage power supply 912 provides a logic level signal that indicates the presence or absence of high voltage output from the supply. This is called the confirmation signal which is generated over line 928 and the confirmation signal is generated upon the operational voltage of the high voltage power supply 912 being achieved at its output. The confirmation signal line 928 is coupled back to the control logic 916. In one embodiment, the voltage level of the high voltage power supply 912 is between 5,000 and 10,000 volts. Removal of the enable signal 926 causes the high voltage power supply 912 to enter a standby state (e.g., zero output on line 934 and minimum input current mode).

The low voltage power supply 918 has an output 938 that can be enabled and disabled by line 930. The Low voltage power supply 918 optionally provides a confirmation logic level signal that indicates the presence or absence of low voltage output from the supply. This optional confirmation signal is generated over line 932 and is generated upon the operational voltage of the low voltage power supply 918 being achieved at its output 938. This optional confirmation signal line 932 is coupled back to the control logic 916. In one embodiment, the voltage level of the low voltage power supply 918 is sufficient to provide the necessary potentials for the emitters and gates, e.g., between −20 and +15 volts. Removal of the enable signal 930 causes the low voltage power supply 918 to enter a standby state (e.g., zero output on line 938 and minimum input current mode).

The control logic 916 of FIG. 9 also generates a third enable signal over line 936 which enables row and column driver circuits 920. The driving circuits 920 convert video image information (from line 942) into electrical potentials 940 specific to each emitter group. The outputs of the driver circuitry 920 can be enabled and disabled via line 936. Removal of the enable signal 936 causes the driver circuitry 920 to enter a standby state (e.g., zero output on lines 940 and minimum input current mode). The driver circuits 920 are coupled to receive a voltage supply from low voltage power supply 918.

As shown in FIG. 9, in order to enable the gate and emitter electrodes, both enable signals 930 and 936 are required. In order to enable the anode electrode, enable signal 926 is required.

Figure 10:
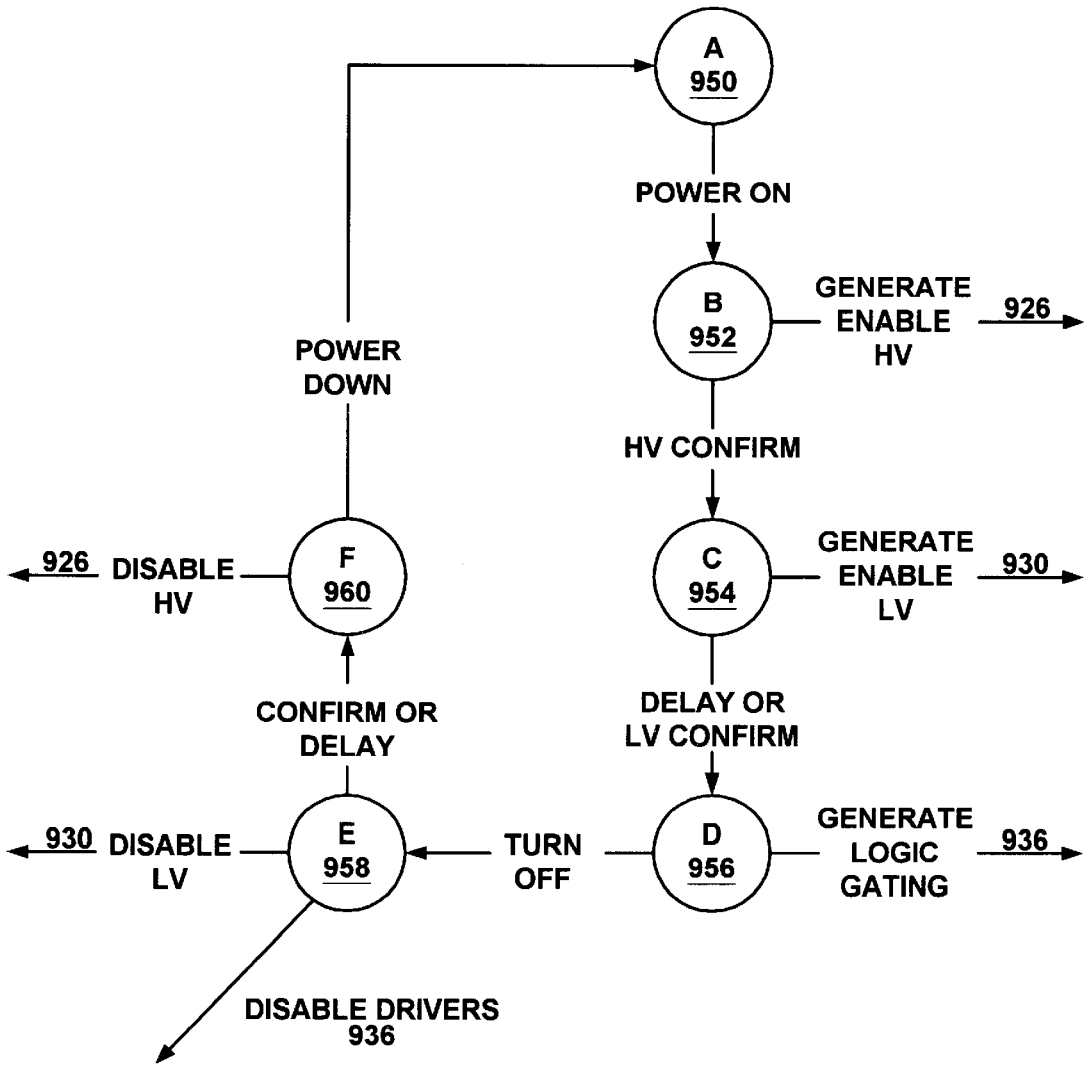
FIG. 10 illustrates a state diagram outlining the control steps performed by the control logic circuit of the circuit of FIG. 9 in accordance with an embodiment of the present invention.

FIG. 10 illustrates a state diagram outlining the control steps performed by the control logic circuit of the circuit of FIG. 9 in accordance with an embodiment of the present invention. This sequence guarantees that the FED will not emit electrons unless there is an anode potential present. This prevents the condition of electron emission without anode potential that can result in emitter and gate degradation.

More specifically, FIG. 10 illustrates the states of an exemplary state machine implementation of the control logic 916. In the initial state 950, power is off and all power supplies and driver circuits of FIG. 9 are disabled. In response to a power on signal, state 952 is entered where the enable line 926 is activated thereby enabling the high voltage power supply 912. Upon the high voltage power supply 912 establishing its operational voltage at its output, a confirmation signal is supplied to the control logic 916 thereby causing state 954 to be entered. At state 954, the control logic 916 generates an enable signal over line 930 to enable the low voltage power supply 918 which had been disabled.

In response to the passage of a predetermined amount of time (delay period), or in response to a confirmation signal over optional line 932, state 956 is entered. At state 956, the control logic 916 then generates an enable signal over line 936 to enable the driver circuits 920. At state 956, the FED screen is fully powered up and enabled. Video information can then be presented onto the FED screen. It is appreciated that by powering-on the gate and emitter electrodes only after the anode has fully powered on, the present invention provides a circuit 910 that substantially reduces emitter and gate electrode degradation. In other words, electron emission from the emitter to the gate electrode is substantially reduces and/or eliminated by circuit 910.

FIG. 10 also illustrates the power-off states of the control logic 916. From state 956, state 958 is entered in response to a power-off signal over line 924, e.g., in response to the on/off switch. At state 958, the driver circuits 920 are disabled via line 936 and also the low voltage power supply 918 is disabled via line 930. In response to the passage of a predetermined amount of time (delay period), or in response to a confirmation signal over optional line 932, state 960 is then entered. At state 960, the high voltage power supply 912 is disabled via line 926. State 950 is then entered.

ALTERNATIVE WAYS TO DETECT FACEPLATE VOLTAGE

The following describes alternative ways in which to detect the presence of voltage on the faceplate, in addition to the methods and systems described above. Detection of the high voltage controls the interlock of the row and column bias voltages. This prevents electrons from being emitted from the cathode when the faceplate high voltage is not present as they can hit the cathode and walls causing outgassing and emission non-uniformities. Below are described methods for detecting the high voltage on the faceplate in addition to using a signal generated by the high voltage power supply.

In one embodiment, the application of the high voltage supply can be detected by monitoring and detecting the current into the focus waffle. The focus waffle is described in more detail in U.S. Pat. No. 5,528,103, assigned to the assignee of the present invention and issued on Jun. 18, 1996 which is incorporated herein by reference. In this embodiment, the system will suspend until the current from the focus waffle stabilizes. The final current value depends on the ambient temperature due to wall TCR. When the current stabilizes, then the rows and columns are enabled and the cathode is enabled.

In another embodiment, the voltage rise at the faceplate is capacitively detected through either the focus waffle or a conducting layer (such as an antistatic cover) over the faceplate. It is appreciated that the signal from the layer over the faceplate will be larger than from the focus waffle because the capacitance is higher. When the voltage stabilizes or reaches it high voltage point, then the rows and columns are enabled and the cathode is enabled.

In another embodiment, the electrostatic force to the faceplate is detected using a micromechanical (MEMS) force detector located at some out of the way corner of the faceplate. When the force reaches a predetermined level that corresponds to the high voltage level, then the rows and columns are enabled and the cathode is enabled.

In another embodiment, a trigger or "sweet" spot (pixel) is located in a corner of the cathode which is activated (preferably in a pulsed mode) whenever the power is on, e.g., the high voltage. Then, light output is detected from a small phosphor patch over the trigger spot. Electrons from this trigger spot will cause some cathode outgassing when the faceplate high voltage was not present, but much less than running the entire cathode. When the trigger spot illuminates, then the rows and columns are enabled and the cathode is enabled. Using this same technology, an alternating current signal can be detected at the faceplate caused by pulsing the additional sweet spot. The current signal indicates that electronic are hitting the faceplate so some high voltage must be present. The current signal then triggers that the rows and columns are enabled and the cathode is enabled. With respect to this embodiment, a separate connection to the anode section can be used and which is connected to the rest of the anode and power supply through a resistor so the current into the anode section can be measured separately.

The present invention, a method and circuit for powering-on and powering-off an FED screen during normal operation to reduce emitter and gate electrode degradation, has thus been disclosed. It should be appreciated that electronic circuits for implementing the present invention, particularly the circuits for delaying the activation of the emissive cathode until a threshold voltage potential has been established, are well known. For instance, it should be apparent to those of ordinary skill in the art, upon reading the present disclosure, that a control circuit responsive to electronic control signals may be used to sense the anode voltage and to turn on the power supply to the row and column drivers after the anode voltage has reached a threshold value. It should also be appreciated that, while the present invention has been described in particular embodiments, the present invention should not be construed as limited by such embodiments, but rather construed according to the below claims.

What is claimed is:

1. A field emission display device comprising:

a display comprising: rows and columns of pixels; and an anode electrode, wherein each of said pixels comprises respective emitter electrodes and respective gate electrodes that are controlled by driver circuitry;

a high voltage power supply coupled to provide a high voltage to said anode electrode;

a low voltage power supply coupled to provide a low voltage to said driver circuitry; and control logic coupled to said high and low voltage power supplies and also coupled to said driver circuitry, said control logic for powering-on said display by first enabling said high voltage power supply and then enabling said low voltage power supply to prevent electron emission from said emitter to said gate electrodes.

2. A field emission display device as described in claim 1 wherein said control logic is also for enabling said driver circuitry after enabling said low voltage power supply.

3. A field emission display device as described in claim 1 wherein said high voltage power supply generates a confirmation signal upon reaching its operating voltage and wherein:

said control logic enables said high voltage power supply by generating an enable signal to said high voltage power supply; and wherein said control logic enables said low voltage power supply by generating an enable signal to said low voltage power supply in response to receiving said confirmation signal from said high voltage power supply.

4. A field emission display device as described in claim 1 wherein said control logic is realized by a state machine sequencer.

5. A field emission display device as described in claim 1 wherein said control logic is also for powering-down said display by first disabling said low voltage power supply and then by disabling said high voltage power supply.

6. A field emission display device as described in claim 1 wherein said high voltage is within the range of 5–10 thousand volts.

7. A field emission display device as described in claim 1 and further comprising a gas-trapping device to trap contaminants within said display.

8. A field emission display device as described in claim 1 wherein said emitter electrodes comprise conical electron emitters.

9. A field emission display device as described in claim 8 wherein said conical electron emitters each comprises a molybdenum tip.

10. A field emission display device comprising:

a display comprising: rows and columns of pixels; and an anode electrode, wherein each of said pixels comprises respective emitter electrodes and respective gate electrodes that are controlled by driver circuitry;

a high voltage power supply coupled to provide a high voltage to said anode electrode and coupled to receive a first enable signal, said high voltage power supply also for generating a confirmation signal upon reaching its operational voltage;

a low voltage power supply coupled to provide a low voltage to said driver circuitry and coupled to receive a second enable signal; and control logic coupled to said high and low voltage power supplies and also coupled to said driver circuitry, said control logic, in response to a powers signal, for powering-on said display by generating said first enable signal and then generating said second enable signal in response to said confirmation signal to prevent electron emission from said emitter to said gate electrodes.

11. A field emission display device as described in claim 10 wherein said driver circuitry is coupled to receive a third enable signal and wherein said control logic is also for enabling said driver circuitry by generating said third enable signal after enabling said low voltage power supply.

12. A field emission display device as described in claim 11 wherein said third enable signal is generated a predetermined period of time after said low voltage power supply is enabled.

13. A field emission display device as described in claim 11 wherein said low voltage power supply generates a confirmation signal upon reaching its operational voltage and wherein said third enable signal is generated after said control logic receives said confirmation signal from said low voltage power supply.

14. A field emission display device as described in claim 10 wherein said control logic is realized by a state machine sequencer.

15. A field emission display device as described in claim 10 wherein said control logic is also for powering-down said display by first disabling said low voltage power supply and then by disabling said high voltage power supply.

16. A field emission display device as described in claim 10 wherein said high voltage is within the range of 5–10 thousand volts.

17. A field emission display device as described in claim 10 and further comprising a gas-trapping device to trap contaminants within said display.

18. A field emission display device as described in claim 10 wherein said emitter electrodes comprise conical electron emitters.

19. A field emission display device as described in claim 18 wherein said conical electron emitters each comprises a molybdenum tip.

20. In a field emission display device having a display having: rows and columns of pixels; and an anode electrode, wherein each of said pixels comprises respective emitter electrodes and respective gate electrodes that are controlled by driver circuitry, a method of powering-on said display device comprising:

a) control logic generating a first enable signal to a high voltage power supply for providing a high voltage to said anode electrode;

b) said high voltage power supply generating a confirmation signal upon reaching its operational voltage;

c) said control logic, in response to said confirmation signal, generating a second enable signal to said low voltage power supply for providing a low voltage to said driver circuitry; and d) trapping contaminants within said display device using a gas-trapping device.

21. A method as described in claim 20 wherein said method further comprises the step of d) said control logic enabling said driver circuitry after enabling said low voltage power supply.

22. A method as described in claim 20 wherein said method further comprises the step of d) said control logic powering-down said display by first disabling said low voltage power supply and then by disabling said high voltage power supply.

23. A method as described in claim 20 wherein said control logic is realized by a state machine sequencer.

24. A method as described in claim 20 wherein said high voltage is within the range of 5–10 thousand volts.

25. A method as described in claim 20 wherein said emitter electrodes comprise conical electron emitters.

26. A method as described in claim 25 wherein said conical electron emitters each comprises a molybdenum tip.

27. A field emission display device comprising:

a display comprising: rows and columns of pixels; and an anode electrode, wherein each of said pixels comprises respective emitter electrodes and respective gate electrodes that are controlled by driver circuitry;

a high voltage power supply coupled to provide a high voltage to said anode electrode;

a low voltage power supply coupled to provide a low voltage to said driver circuitry;

detecting means for detecting high voltage at said anode electrode; and control logic coupled to said high and low voltage power supplies and also coupled to said driver circuitry, said control logic for powering-on said display by enabling said low voltage power supply after high voltage is detected at said anode electrode by said detecting means.

28. A display as described in claim 27 wherein said control logic enables said high voltage power supply upon power on by generating an enable signal to said high voltage power supply; and wherein said control logic enables said low voltage power supply by generating an enable signal to said low voltage power supply in response to receiving a signal from said detecting means.

29. A display as described in claim 28 wherein said display further comprises a focus waffle and wherein said detecting means comprises a circuit for detecting current into said focus waffle.

30. A display as described in claim 28 wherein said display further comprises a focus waffle and wherein said detecting means comprises a circuit for capacitively detecting a voltage rise at said anode through said focus waffle.

31. A display as described in claim 28 wherein said display further comprises a conducting layer over said anode and wherein said detecting means comprises a circuit for capacitively detecting a voltage rise at said anode through said conducting layer.

32. A display as described in claim 28 wherein said detecting means comprises a micromechanical force detector detecting the electrostatic force to said anode.

33. A display as described in claim 28 and further comprising:

a subpixel positioned near said cathode and activated when power is on by pulsing; and a phosphor patch located over said subpixel; and wherein said detecting means is for detecting light emitted from said subpixel.

34. A display as described in claim 28 and further comprising:

a subpixel positioned near said cathode and activated when power is on by pulsing; and an independently connected anode section located over said subpixel; and wherein said detecting means is for detecting current signals from said anode and corresponding to said subpixel.

35. A display as described in claim 34 wherein said independently connected anode section is a phosphor patch.

* * * * *